US005115729A

United States Patent [19]

Beckman et al.

[11] Patent Number: 5,115,729

[45] Date of Patent: May 26, 1992

[54] STAMPER HAVING ADJUSTABLE DIE DEPTH

[75] Inventors: Frederick S. Beckman, South Bend, Ind.; Paul Down, Berrien Springs, Mich.

[73] Assignee: Superior Marking Equipment Co., Chicago, Ill.

[21] Appl. No.: 638,399

[22] Filed: Jan. 7, 1991

[51] Int. Cl.[5] ..... B41K 1/56; B41K 1/02

[52] U.S. Cl. ..... 101/327; 101/405

[58] Field of Search ..... 101/327, 333, 368, 379, 101/371, 372, 373, 381, 380, 405, 406, 103, 109

[56] References Cited

U.S. PATENT DOCUMENTS

| | | | |
|---|---|---|---|
| D. 231,027 | 3/1974 | Funahashi | D64/10 |
| D. 231,028 | 3/1974 | Funahashi | D64/10 |
| D. 232,001 | 7/1974 | Funahashi | D64/10 |
| D. 232,485 | 8/1974 | Funahashi | D19/02 |
| D. 233,174 | 10/1974 | Funahashi | D64/10 |
| D. 233,563 | 11/1974 | Funahashi | D64/10 |
| D. 236,752 | 9/1975 | Funahashi | D64/10 |
| D. 236,754 | 9/1975 | Funahashi | D64/10 |
| D. 240,966 | 8/1976 | Funahashi | D64/10 |
| D. 241,979 | 10/1976 | Funahashi | D64/10 |
| D. 268,187 | 3/1983 | Funahashi | D18/15 |
| D. 273,120 | 3/1984 | Ito | D18/15 |
| D. 275,687 | 9/1984 | Funahashi | D18/15 |
| D. 280,643 | 9/1985 | Ichikawa | D18/15 |
| D. 280,733 | 9/1985 | Fujikura | D18/15 |
| D. 280,910 | 10/1985 | Fujikura | D18/15 |
| D. 284,014 | 5/1986 | Iwasaki et al. | D18/15 |
| 42,819 | 5/1864 | Jenks | 101/406 |
| 229,282 | 6/1880 | Spooner | 101/30 X |
| 778,386 | 12/1904 | Tenney | 101/373 |
| 1,179,979 | 4/1916 | Troup | 101/371 |
| 1,291,057 | 1/1919 | Marks | 101/103 |
| 1,353,994 | 9/1920 | Folger et al. | 101/103 |
| 1,604,035 | 10/1926 | Goddefroy | 101/28 |
| 2,839,994 | 6/1958 | Haag | 101/372 |
| 2,900,902 | 8/1959 | Becker | 101/368 |
| 2,920,559 | 1/1960 | Becker | 101/405 |
| 2,946,279 | 7/1960 | Huppert | 101/103 |
| 2,950,676 | 8/1960 | Weissman et al. | 101/334 |
| 3,033,112 | 5/1962 | Cleveland et al. | 101/334 |
| 3,277,601 | 10/1966 | Ryan | 46/161 |
| 3,362,326 | 1/1968 | Delpo et al. | 101/316 |
| 3,631,799 | 1/1972 | Funahashi | 101/327 |
| 3,832,947 | 9/1974 | Funahashi | 101/327 |
| 3,855,925 | 12/1974 | Funahashi | 101/333 |
| 3,885,495 | 5/1975 | Funahashi | 101/327 |
| 3,955,499 | 5/1976 | Funahashi | 101/111 |
| 4,022,127 | 5/1977 | Carlsson et al. | 101/327 |
| 4,029,012 | 6/1977 | Smith, III et al. | 101/358 |
| 4,033,257 | 7/1977 | Funahashi | 101/111 |
| 4,038,918 | 8/1977 | Funahashi | 101/111 |
| 4,054,093 | 10/1977 | Funahashi | 101/327 |
| 4,064,802 | 12/1977 | Funahashi | 101/327 |
| 4,127,063 | 11/1978 | Peterson et al. | 101/3 R |
| 4,182,261 | 1/1980 | Smith, III et al. | 118/31.5 |
| 4,203,362 | 5/1980 | Underwood et al. | 101/327 |
| 4,289,070 | 9/1981 | MacGregor | 101/327 |
| 4,291,622 | 9/1981 | Bengtsson | 101/368 |
| 4,304,421 | 12/1981 | Kuhbier | 280/817 |
| 4,363,101 | 12/1982 | Ahrens | 101/327 |
| 4,395,948 | 8/1983 | Monich | 101/405 |
| 4,411,192 | 10/1983 | Fujihara | 101/111 |
| 4,432,281 | 2/1984 | Wall et al. | 101/334 |
| 4,594,943 | 6/1986 | Nettesheim et al. | 301/327 |
| 4,649,819 | 3/1987 | Voto, Jr. et al. | 101/327 |
| 4,676,162 | 6/1987 | Phipps, Sr. et al. | 101/405 |
| 4,735,143 | 4/1988 | Weir | 101/333 |

FOREIGN PATENT DOCUMENTS

| | | |
|---|---|---|
| 847088 | 7/1970 | Canada . |
| 584709 | 9/1933 | Fed. Rep. of Germany . |
| 753621 | 10/1933 | France . |

*Primary Examiner*—Clifford D. Crowder
*Attorney, Agent, or Firm*—Willian Brinks Olds Hofer Gilson & Lione

[57] ABSTRACT

A pre-inked stamper has an adjustable die depth to accommodate shrinkage and to vary die impression. Adjustment is accomplished by rotation of a handle about a shaft which is attached to the die to thereby alter the stroke. A ratchet and pawl mechanism includes a plurality of grooves having camming surfaces formed on an end of the shaft located adjacent the handle. A pawl selectively engages the grooves and biases the handle against unintended rotation.

3 Claims, 2 Drawing Sheets

STAMPER HAVING ADJUSTABLE DIE DEPTH

FIELD OF THE INVENTION

This invention relates to a manually operated ink stamp having a die depth which can be adjusted by rotating the handle of the ink stamp. More particularly, the present invention relates to a novel ratchet and pawl arrangement for the relative movement of the handle of the stamp for such adjustment.

BACKGROUND OF THE INVENTION

Ink stamps which utilize a die for imparting a design or printed message on a suitable surface have found usefulness in a variety of settings. Such stamps typically are utilized in combination with an ink pad containing a supply of ink. When using the stamp, the die is pressed against the ink pad, thereby coating the die with a thin layer of ink. When the die is subsequently pressed against a surface, a design corresponding to that found on the die is imprinted on the surface.

A primary disadvantage to such stampers is the inconvenience of having to use the stamper with an ink pad, which in many cases is not part of the stamper. A supply of the ink for the pad is also required. Additionally, the use of such ink pads frequently results in the uneven application of ink to the die. The amount of ink applied to the die by the ink pad also varies according to the pressure applied on the die; thus, it can be difficult to ensure that the same amount of ink is applied to the die during successive applications of ink to the die.

As a result of these disadvantages, ink stamps having a self-contained supply of ink have been developed wherein the die material is saturated with ink. No pad is needed, nor is pre-inking required, since the die contains the ink. Such a die is described in U.S. Pat. Nos. 3,832,947 and 4,022,127. Ink stamps of this type typically have the die mounted to a die holder. The die holder is, in more sophisticated stampers of this type, attached to a shaft which, in turn, is attached to a cap or handle. Surrounding the die is a shroud or cover skirt. The die holder is normally biased to a position within the cover skirt, such that the cover skirt extends beyond the face of the die.

To use the ink stamp, the stamp is set upon the surface to be imprinted with the cover skirt resting on the surface. A vertical force is applied to the handle which force overcomes the biasing force between the cover skirt and the handle and pushes the die into contact with the surface to be imprinted, where it can then be pressed firmly against that surface.

To provide a consistent impression, the distance the die can be pushed beyond the edge of the cover skirt is limited, as by the distance the handle can travel. For instance, a stop to prevent further travel of the handle can be used to define the stroke or maximum distance of travel of the die, which moves axially with the handle.

With use, however, the die contracts. Additionally, as the ink in the stamp becomes used, it is necessary to apply a greater pressure on the stamp to obtain a quality of imprint consistent with that when the die was newer. Thus, to remain effective, the stamper must be adjustable so that any contraction and ink loss of the die may be compensated for, as by increasing the distance the handle may be pushed down (i.e., increasing the stroke.

An effective means for adjusting the stroke is by permitting the distance between the die and the handle to be adjusted, i.e. allowing for adjustability of the effective length of the shaft which connects the die holder and the handle. This is commonly accomplished by attaching the handle to the shaft with a threaded connection.

Accordingly, to increase the effective length of the shaft, the handle may be "unscrewed" a few turns thereby lengthening the distance between the handle and the die. Thus, when the handle is pushed against its biasing force and towards the cover skirt, it must travel a greater distance before coming into contact with the stop, thereby increasing the stroke.

It is desirable to ensure that the stroke remains set once adjusted. Mechanisms to prevent inadvertent rotation of the handle while using the stamp have therefore been developed. One such using a locking mechanism is disclosed in U.S. Pat. No. 4,203,362.

In the '362 disclosure, a locking member fits between the cover skirt and the handle. One end of the locking member is configured to fit within the handle to prevent relative rotational movement with respect to the handle. On its other end, the locking member has a plurality of ribs which mate with corresponding projections in the end of the cover skirt. When the ribs of the locking member are in mating connection with the projections on the cover skirt, relative rotational movement between the cover skirt and the locking member is prevented. Thus, the locking member provides a positive lock which prevents rotational movement between the handle and the cover skirt.

To adjust the stroke of the '362 stamper, the locking member must be moved upwardly along the shaft of the handle, thereby removing the ribs from mating connection with the projections on the cover skirt. In this position, the handle is free to rotate on its threaded connection with the shaft.

A similar mechanism is disclosed in U.S. Pat. No. 4,649,819. It differs from the '362 locking mechanism in the type of ribs and projections utilized to prevent relative rotational movement between the locking member and the cover skirt. The '819 utilizes tapered teeth in the locking member and corresponding tapered teeth in the cover skirt. The locking action can be overcome either by using the aforementioned procedure whereby the locking member is disengaged, or by rotation of the handle with sufficient force to overcome the engagement.

A primary disadvantage to the mechanisms disclosed in both of the foregoing patents is that their manufacture is complicated by the use of the locking member. The locking member is a separate part to be produced and then assembled. This increases manufacturing costs of the stamp, an item which must be produced at a low cost if it is to be commercially successful. Adjustment also entails two different movements: one being the rotary movement of the handle, the other being the axial movement of the locking member.

The locking member of the '819 stamper also acts as a stop as the handle is depressed towards the cover skirt. Thus, if one attempts to adjust the stamp while the handle is in the depressed position, a sufficient torsional force applied to the handle could deform and/or break the teeth or ribs which prevent relative movement between the locking member and the base.

Yet another adjustment mechanism of this general type is disclosed in U.S. Pat. No. 4,594,943. Similar to both the '362 and the '819 patents, the stamper of the '943 patent utilizes the base as one element of an antirotation mechanism. As can be seen by reference to the disclosure of the '943 patent, the components which comprise the mechanism are somewhat complex in their design, and the adjustment mechanism requires some precision in manufacture and assembly.

SUMMARY OF THE INVENTION

The present invention provides a stamper having an adjustable die stroke with a simple effective ratchet and pawl mechanism to prevent undesired rotational movement of a handle, which is used to effect the stroke adjustment, with respect to the shaft upon which the handle is engaged.

In a preferred embodiment, the present invention includes a handle or cap threadably attached to one end of a shaft. Attached to the opposite end of the shaft is an inked die mounted to a die plate. Thus, the handle, the shaft, the die and the die plate form one substantially rigid piece.

A cover skirt surrounds the die and die plate, and is slidably attached to the shaft, such that the shaft may freely move up and down with respect to the skirt. The cover skirt is preferably biased towards the die and away from the handle with a spring located between the handle and the cover skirt. So configured, when the stamp is set on a surface to be imprinted, the force of the spring against the handle retains the die plate retracted inside the cover skirt and allows the cover skirt to rest upon the surface to be imprinted. By pressing down on the handle against the force of the spring, the die is extended and comes into contact with the surface to be imprinted.

When the handle is pressed against the spring, it eventually comes into contact with a stop in the form of an upwardly extending portion of the cover skirt. Thus, the stroke or maximum distance the die can travel with respect to the cover skirt is defined by the distance between the handle bottom and the cover skirt. The stroke may be lengthened by increasing the distance between the handle and the die—the effective length of the shaft. This is done by rotating the handle with respect to the shaft, causing the handle to move along its threaded connection with the shaft.

The novel ratchet and pawl mechanism of the present invention prevents the handle from freely rotating along its threaded connection with the shaft. The ratchet and pawl mechanism is located entirely inside a cavity in the handle in the disclosed embodiment. The end of the shaft, upon which the handle is threadably attached, extends into this cavity. A plurality of grooves forming camming surfaces are formed around this end of the shaft, and constitute the ratchet. Attached to the handle inside the cavity is a pawl which is normally biased into engagement within one of the grooves on the ratchet (shaft end).

As the handle is rotated, the torsional force on the handle forces the pawl to slide along the camming surface of a ratchet groove, thereby causing the pawl to move into and out of engagement from groove to groove. When the stamp is adjusted as desired, the biasing force on the pawl against the groove is sufficient to prevent rotation of the handle about the shaft during normal use of the stamp.

Because the ratchet and pawl mechanism is located entirely within the handle, and operates only on the handle and shaft, its ability to function is not affected by the relative position of the cover skirt or die plate. Thus, even if the handle is firmly pressed against the stop on the cover skirt, it may be rotated without risk of damaging the mechanism. Additionally, because no separate locking member is employed as part of the inventive mechanism, forces being applied to the handle in the direction of the shaft, i.e., axially, as the stamp is being adjusted do not affect the workings of the ratchet mechanism, such as might occur when a separate locking member is utilized. The present adjustment mechanism is simple, involves a minimum number of parts, and is readily assembled.

The objects and advantages of the present invention will be further understood upon consideration of the following description of a preferred embodiment taken in conjunction with the accompanying drawings, in which:

DETAILED DESCRIPTION OF A PREFERRED EMBODIMENT OF THE INVENTION

Figure 3:
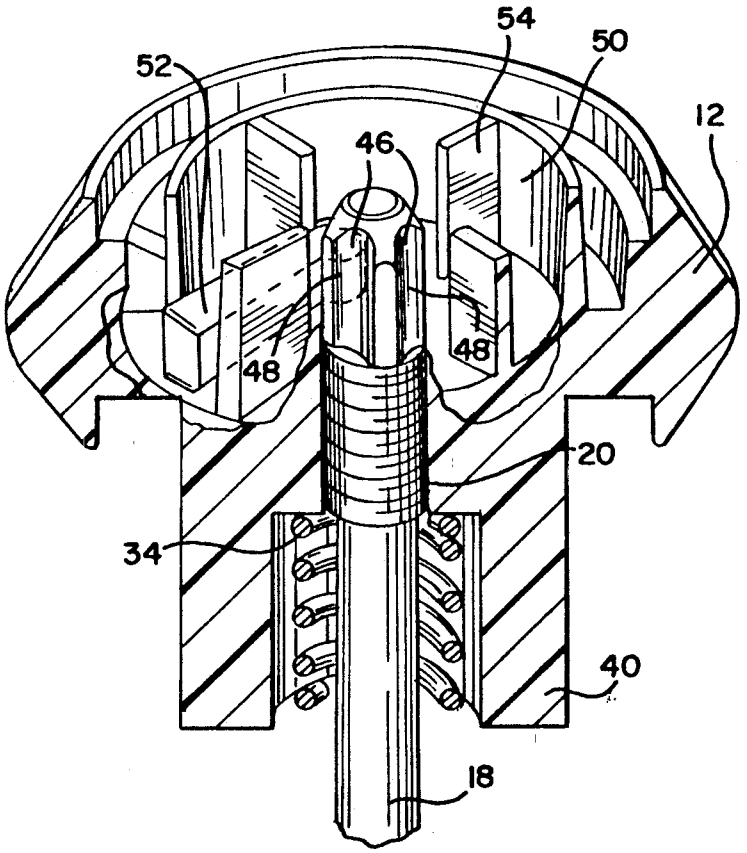
FIG. 3 is an enlarged perspective view of the top portion of the stamper of FIG. 2, with portions cut away to illustrate the ratchet and pawl assembly.
Figure 1:
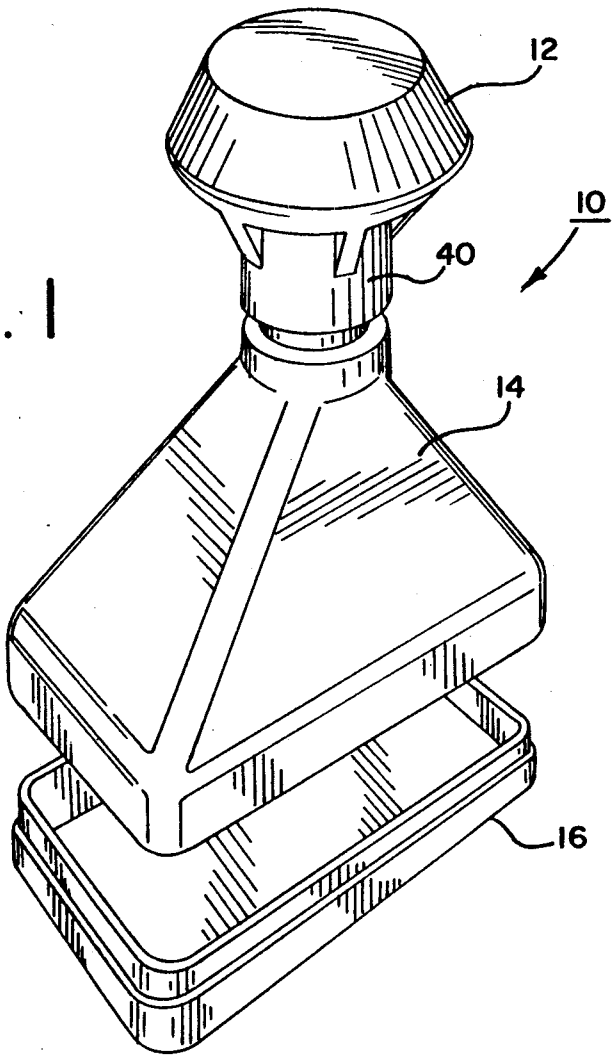
FIG. 1 is a perspective view of a stamper made in accordance with the present invention.

Reference is now made to the FIGS. wherein like parts are referred to by like numerals throughout. A manual stamping device according to the present invention is generally designated at 10. The stamper 10 includes a handle 12, a cover skirt 14 which covers the die 26 and a lower die cover 16. The lower die cover 16 keeps debris away from the die when the stamp is not being used, and helps prevent it from drying out.

The handle 12 is threadably attached to a shaft 18 at threads 20. At its other end, shaft 18 is fixed to a die plate 22. The die plate 22 includes reinforcing ribs 24. An imprinting member or die 26 is attached to the die plate within a cavity 30.

Figure 2:
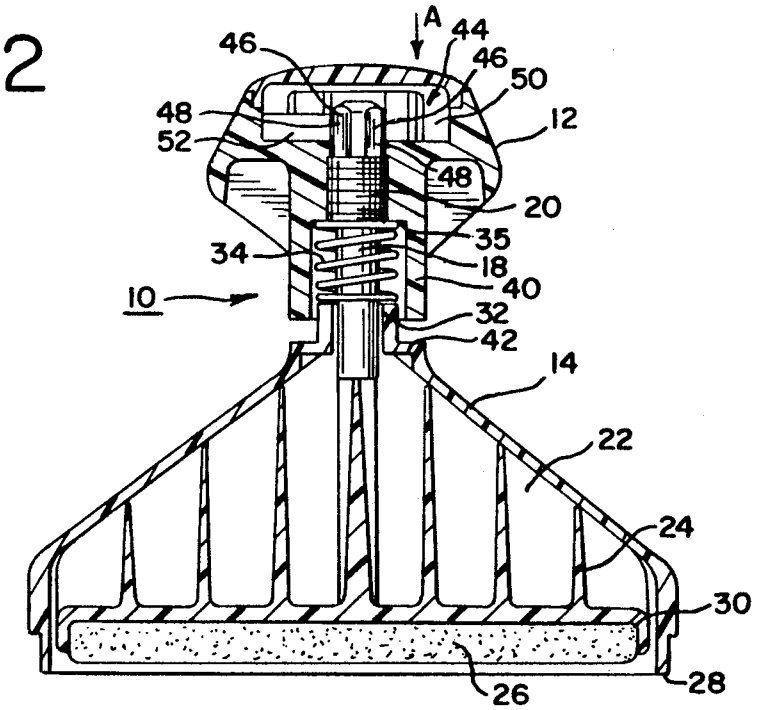
FIG. 2 is a cross-sectional view of the stamper of FIG. 1.

The cover skirt 14 covers and surrounds the die plate 22. In particular, the outer surface 28 of the cover skirt 14 extends beyond the edge of the die 26, with the die in a retracted position, as shown in FIG. 2. The die 26 does not contact the surface upon which the stamper is resting in this retracted position.

The upward portion of the cover skirt 14 has a collar 32, through which extends the shaft 18 below the threads 20. The shaft 18 fits loosely within the collar 32 to permit rotational and axial movement of the shaft 18 within the collar 32.

A spring 34 is mounted around the shaft 18. One end of the spring 34 rests against a shoulder 35 formed within a well defined by a collar portion 40 of the handle 12. The other end of the spring 34 rests against the top of the collar 32. The spring 34 biases the handle 12 away from the cover skirt 14, thereby retaining the die plate in the retracted position.

When it is desired to use the stamp, a downward force, i.e., in the direction of arrow A, is applied to the handle 12. The force must be of sufficient magnitude to overcome the biasing force of spring 34, thereby causing the handle 12, the shaft 18 and the die plate 22 to move downwardly with respect to the cover skirt 14. Such downward movement causes the die 26 to move from its retracted position inside the cover skirt 14 (as shown in FIG. 2) to an extended position wherein the die may contact the surface to be imprinted.

The end of collar 40 comes into contact with a stop 42 in the form of a circular shoulder on the cover skirt, as the die is moved into its extended position. Thus, the vertical distance through which the die 26 moves as it travels from its retracted position to its extended position—sometimes referred to herein as the "stroke" of the stamper—is defined by the vertical distance between the end of the collar 40 on the handle 12 and the stop 42 on the cover skirt 14.

It is necessary to increase the stroke to compensate for any shrinkage in the die 26 which may occur over time. Additionally, as the ink contained within the die 26 is used up, additional pressure must be applied to the die to obtain a consistent imprint.

The stroke can be adjusted by rotating the handle 12 with respect to the shaft 18 along the threads 20, thereby adjusting the effective length of the shaft 18, i.e., the distance between the end of collar 40 and stop 42. Increasing the effective length of the shaft 18 causes the die 26 to extend further beyond the outer surface 28 of the cover skirt 14 when the die is moved from its retracted position to its extended position.

The handle is biased against rotation by a ratchet and pawl mechanism, shown generally at 44. The mechanism 44 includes a plurality of vertical grooves 46 formed on a hub on the end of the shaft 18. Camming surfaces 48 are thereby formed on each side of a groove, constituting a reversible ratchet. The grooves 46 are regularly spaced around the hub, and extend into a cavity 50 within the handle 12.

Also located within the cavity 50 is a pawl 52 held at one end between opposing walls 54 and 56 formed within the handle. The pawl has a free end which is arranged to engage in grooves 46 seriatim when the shaft 18 is rotated. The pawl 52 is rigidly held only at one end, thereby permitting deflection of the pawl as the handle 12 is rotated with respect to the shaft 18.

Figure 4:
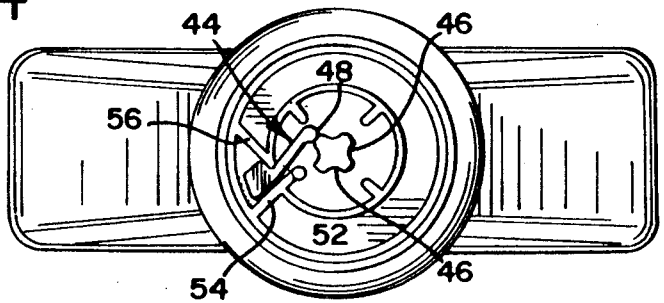
FIG. 4 is a top plan view of the stamper of FIG. 2 with the top of the handle removed.

At the inception of rotation, the pawl 52 is forced against a camming surface 48 of a ratchet groove 46 with which it had been engaged. The rotational force must, therefore, be sufficient to cause the pawl 52 to deflect a sufficient amount to permit the pawl to entirely disengage from the groove 46, as illustrated in FIG. 4. As rotation continues, the pawl 52 moves into engagement with an adjacent groove. As the handle is rotated, the pawl engages and disengages each of the groove as they pass a position of alignment with the pawl.

The force of the pawl 52 against a camming surface 48 of a groove 46 with which the pawl had been engaged acts to bias the assembly against rotation. This biasing force is typically not overcome during normal use of the stamp for imprinting surfaces, but may be easily overcome when it is desired to adjust the stroke of the stamp by rotating the handle.

Because the ratchet mechanism 44 does not act on the cover skirt 14, the stamp may be adjusted regardless of the relative position of the cover skirt and regardless of any axial forces. No special molding for the adjustment mechanism is required, save for fixation of the pawl end in this embodiment; the pawl could be fixed in other manners not requiring such molding.

It should be appreciated that while the present invention has been described with relation to a particular embodiment, the invention may be embodied in other forms without departing from its spirit or essential characteristics. The described embodiment is therefore to be considered as illustrative and not restrictive of the scope of the invention, which is defined by the claims herein. All changes which come within the meaning and range of equivalency of the claims are to e embraced within their scope.

What is claimed is:

1. In a stamper having a handle connected to a threaded shaft which in turn is connected to a die, and having an adjustable die stroke wherein the die stroke is a by rotation of the handle upon the threaded shaft, the improvement comprising:

a ratchet having a plurality of camming surfaces formed on one of said handle and shaft, and a pawl carried by the other of said handle and shaft;

said pawl engaging in each of said camming surfaces seriatim upon rotation of said handle, said pawl being biased against movement along said camming surfaces, such bias being overcome by a sufficient rotational force applied to said handle.

2. A stamper having an adjustable die stroke as set forth in claim 1, wherein said pawl is a flexible member with one end fixed to said handle and another end free to engage said camming surfaces, said camming surfaces comprising sidewalls of grooves formed along a longitudinal axis of said shaft and surrounding a portion of said shaft in the area of said pawl free end.

3. An adjustable, self-inking stamper, comprising:

a handle;

a shaft upon which said handle is threadably and rotatably mounted at one end, said shaft defining a longitudinal axis for the stamper;

a die containing a supply of ink, a die plate to which said die is affixed, said die plate being attached to said shaft;

a skirt member surrounding said die and die plate and within which said die and die plate are received, said skirt having an opening through which said shaft passes, longitudinal movement of said shaft with respect to said skirt moving said die and die plate from a first retracted position to a second extended position, said handle contacting a stop formed on said skirt member to define said extended position, said extended position being adjustable by rotating said handle about said shaft along said threads, a ratchet having a plurality of grooves formed on said shaft, said grooves defining camming surfaces, and a pawl mounted to said handle to selectively engage said grooves seriatim, said pawl biased to resist movement along said camming surfaces and thereby resist rotary movement of said handle, said pawl being deflectable by a sufficient rotary force applied to the handle to move the pawl along a camming surface of the groove and deflect as it moves from an engaged position within a groove to an engaged position with in another groove.

* * * * *